United States Patent [19]

Ogura

[11] 4,341,462

[45] Jul. 27, 1982

[54] COPYING MACHINE WITH COLLATING APPARATUS

[75] Inventor: Masaaki Ogura, Tokyo, Japan

[73] Assignee: Ricoh Company, Ltd., Tokyo, Japan

[21] Appl. No.: 190,106

[22] Filed: Sep. 24, 1980

[30] Foreign Application Priority Data

Apr. 7, 1980 [JP] Japan ..... 55-44714

[51] Int. Cl.[3] ..... G03G 15/00

[52] U.S. Cl. ..... 355/14 SH; 271/4; 271/259; 271/288; 355/3 SH

[58] Field of Search ..... 355/3 R, 3 SH, 14 SH, 355/14 R; 271/4, 9, 259, 288, 297

[56] References Cited

U.S. PATENT DOCUMENTS

| | | | |
|---|---|---|---|
| 3,944,794 | 3/1976 | Reehil et al. | 355/14 SH X |
| 4,026,543 | 5/1977 | Leclere | 271/259 |
| 4,200,386 | 4/1980 | Queener | 355/14 SH |
| 4,285,508 | 8/1981 | Kaneko | 271/4 |

*Primary Examiner*—Fred L. Braun

*Attorney, Agent, or Firm*—David G. Alexander

[57] ABSTRACT

A collator has a manual sheet insertion device which permits desired sheets to be delivered into the collator independently of copy sheets which will be passed thereto from a copying machine. The manual sheet insertion device includes a manual sheet insertion sensor responsive to manual insertion of each sheet through this device and a sheet entry sensor responsive to entry of each sheet into a bin. The copying machine includes a sheet feed sensor whose output is adapted to operate a sheet feed counter. When sheets other than those fed from the copying machine are introduced one by one in the collator through the manual insertion device, the sheet feed counter has its count corrected in response to an output signal of the manual sheet insertion sensor and in accordance with the count of a sheet entry counter which is operated by an output signal of the sheet entry sensor. With this correction, the remaining number of sheets to be copied can be surely processed by the copying machine after the delivery of the manually inserted sheets into the collator; the copies will be conveyed successively into the collator after the manually inserted sheets.

9 Claims, 9 Drawing Figures

COPYING MACHINE WITH COLLATING APPARATUS

BACKGROUND OF THE INVENTION

The present invention relates to a copying machine equipped with a document collating apparatus (collator) and, more particularly, to an improved copying machine with a collator which is provided with a manual sheet insertion device.

Generally, a collator has a plurality of sheet storing bins arranged one upon another and operates in a collation mode to distribute a set of copy sheets one by one into individual bins. The collator is also operable in a sorting or assortment mode in which copy sheets are fed or delivered successively into a single bin until a predetermined number is reached and then copy sheets are fed in the same way to the next bin.

A conventional copying machine with a collator usually has such a design that, after the completion of exposure, the copying operation for the next document page can be started. This inherent design brings about the following problem where there is a relatively long copy conveyance path including the copying machine body and collator, and sheets become jammed in such a conveyance path.

A conventional practice to deal with jammed copy sheets is either to pick them up from the copy conveyance path and manually put them in determined bins of a collator or to practically waste them even if they are acceptable with a view to avoiding awkwardness. However, when the copy sheets were put in the bins by manual work, the remaining number of sheets to undergo further copying cycles needs be determined by troublesome calculation. It is sometimes desired during collation or assortment with a collator to divide each volume of copy sheets into multiple sections by interposing colored or like non-copied sheets between intended pages. To achieve this purpose with a conventional collator, operator must manually deliver such additional sheets directly into selected bins or feed them from an additional sheet cassette positioned in advance in the copying machine and process them into monochromatic copies with use of a monochromatic document sheet. These monochromatic copies will travel the conveyance path in the copying machine and out therefrom into the bins of the collator as ordinary copy sheets do.

Thus, in connection with prior art collators, operator has to perform very troublesome work to deal with sheet jams and the like or very intricate manipulation when he desires to introduce colored or like additional sheets other than copy sheets into the collators.

SUMMARY OF THE INVENTION

A copying machine including a collator provided with a manual sheet insertion device embodying the present invention comprises setting means for setting a number of sheets to be copied by the copying machine, sheet feed sensor means provided in a sheet feed station of the copying machine to detect feeding of sheets from the sheet feed station, manual sheet insertion sensor means provided in the manual sheet insertion device to detect insertion of a sheet into the manual sheet insertion device, sheet entry sensor means provided in the collator to detect entry of sheets into bins of the collator and control means responsive to outputs of the setting means, the sheet feed sensor means, the manual sheet insertion sensor means and the sheet entry sensor means to control the copying machine and the collator such that when a sheet is manually inserted into the manual sheet insertion device, a number of sheets fed from the sheet feed station is automatically corrected in response to the entry of said sheet into a desired bin of the collator.

In accordance with the present invention, a collator has a manual sheet insertion device which permits desired sheets to be delivered into the collator independently of copy sheets which will be passed thereto from a copying machine. The manual sheet insertion device includes a manual sheet insertion sensor responsive to manual insertion of each sheet through this device and a sheet entry sensor responsive to entry of each sheet into a bin. The copying machine includes a sheet feed sensor whose output is adapted to operate a sheet feed counter. When sheets other than those fed from the copying machine are introduced one by one in the collator through the manual insertion device, the sheet feed counter has its count corrected in response to an output signal of the manual sheet insertion sensor and in accordance with the count of a sheet entry counter which is operated by an output signal of the sheet entry sensor. With this correction, the remaining number of sheets to be copied can be surely processed by the copying machine after the delivery of the manually inserted sheets into the collator; the copies will be conveyed successively into the collator after the manually inserted sheets have been entered into the bin.

It is an object of the present invention to provide a copying machine with a collating apparatus which, with a manual sheet insertion device provided to the collator, permits delivery of sheets into the collator independently of copy sheets transferred from the copying machine and promotes sure processing of the remaining number of sheets in the copying machine.

It is another object of the present invention to provide a copying machine with a collating apparatus which in the event of a sheet jam automatically detects or calculates the number of a remaining part of an initially set desired number of copy sheets even after the removal of jammed sheets without relying on the operator's judgement and allows the remaining sheets to be processed surely in the copying machine.

It is another object of the present invention to provide a copying machine with a collating apparatus which makes it possible during collation or assortment with the collator to interpose a colored sheet or the like other than copy sheets between desired pages of each intended volume.

It is another object of the present invention to provide a collating apparatus which greatly speeds up and facilitates the handling of sheet jams.

It is another object of the present invention to provide a generally improved copying machine having a collating apparatus.

Other objects, together with the foregoing, are attained in the embodiment described in the following description and illustrated in the accompanying drawing.

BRIEF DESCRIPTION OF THE DRAWING

FIG. 8 shows a control panel provided with ten keys, indicators, print start key and the like.

DESCRIPTION OF THE PREFERRED EMBODIMENTS

While the copying machine with the collating apparatus provided with the manual sheet insertion device of the present invention is susceptible of numerous physical embodiments, depending upon the environment and requirements of use, substantial numbers of the herein shown and described embodiments have been made, tested and used, and all have performed in an eminently satisfactory manner.

Figure 1:
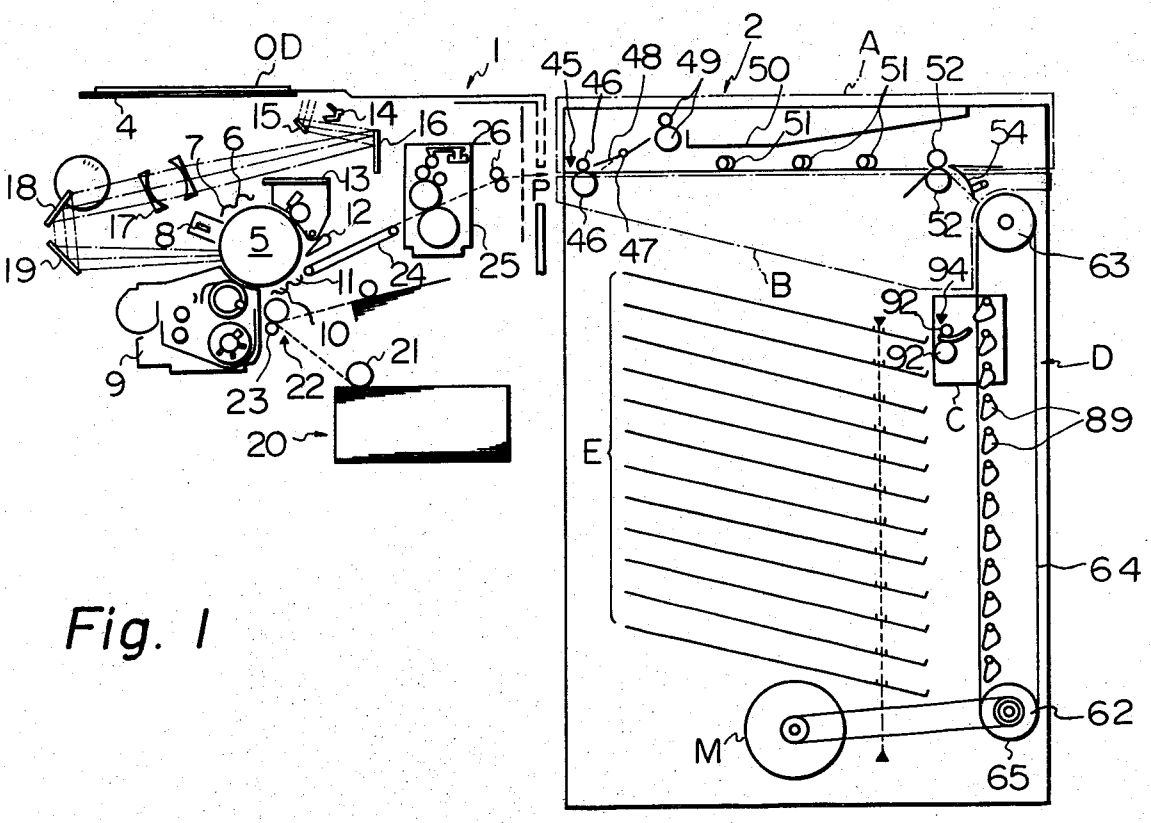
FIG. 1 schematically shows a copying machine equipped with a collating apparatus.

Referring to FIG. 1, there are shown a copying machine 1 and a collator 2 operatively connected to the copying machine 1.

The copying machine 1 includes a photosensitive drum 5 around which are disposed a charge neutralizing or discharging charger 6, a main charger 7, a charge removing lamp 8, a developing unit 9, a transfer charger 10, a separating charger 11, a separating pawl 12 and a cleaning unit 13. The reference numeral 14 denotes a halogen lamp serving as part of a scanner of a slit exposure device. In operation, the drum 5 is first deposited with a uniform surface charge by the charge 7. The halogen lamp 14 moves to illuminate a document OD on the glass platen 4 and light reflected from the document is re-reflected by first and second mirrors 15 and 16 and transmitted through a converging lens 17 to slit-expose the drum surface. An area of the drum 5 now carrying a latent image is processed by the developing unit 9 and has the latent image developed into a visible toner image. Meanwhile, a transfer sheet is fed from a sheet feed station 20 by a lower feed roller 21 or an upper feed roller 21' to a pair of registration rollers 23. This sheet in the stand-by at the roller pair 23 is advanced therefrom at a suitable timing to register with the toner image on the drum 5. Then the transfer charger 10 transfers the toner image onto the sheet whereupon the charger 11 and pawl 12 for separation remove the sheet from the drum surface. The sheet now clear of the drum 5 is transferred by a conveyor belt 24 to a fixing unit 25. The sheet having the toner image fixed thereon advances through a pair of discharge rollers 26 to the outside of the machine housing and enters the collator 2 next to the copying machine 1. The surface of the drum 5 is cleaned by the cleaning unit 13 to get ready for another copying cycle.

In the sheet feed station 20, a sheet feed sensor 22 is located in a position adjacent to the sheet inlet side of the roller pair 23 so as to monitor the feeding of sheet by means of the rollers 21 or 21'.

The collator 2 is shown to comprise a sheet aligning section A, a feeder section B disposed below the sheet aligning section A, a vertically movable deflecting device C adapted to direct copies to selected bins, a conveyor section D supporting the deflector C and conveying copy sheets from the section A or B to the deflector C, an array of bins E, and a motor M.

Figure 2:
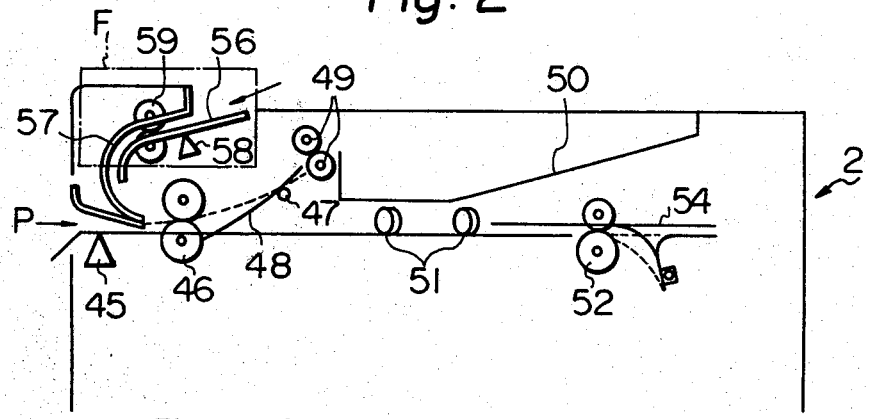
FIG. 2 is a fragmentary view of a manual sheet insertion device provided in the collating apparatus.

Referring to FIGS. 1 and 2, a copy sheet or copy discharged from the copying machine 1 enters the collator 2 as indicated by an arrow P and, while being monitored by a sheet sensor 45, is caught by a pair of inlet rollers 46. These rollers 46 advance the copy sheet to a guide plate 48 whose position is controlled by a solenoid 47. Depending on its position, the guide plate 48 directs the copy sheet either to a temporary discharge tray 50 or horizontally to skew rollers 51 for collation or assortment.

The skew rollers 51 bias the copy sheet toward a reference plate (not shown) so as to provide the copy sheet with a given position and a given orientation. A pair of intermediate rollers 52 feed the copy sheet further to a path selector plate 54. The path selector plate 54 will deliver the copy sheet to the conveyor section D.

A section F indicated by a dot-and-dash line in FIG. 2 is for manual insertion of sheets. A sheet is inserted manually between guide plates 56 and 57 until it is detected by a sheet sensor 58. Then, if the mechanism is capable of accommodating manual insertion, a clutch (not shown) in the section F will drive a pair of rollers 59 for rotation. When the sheet is further advanced by the roller pair 59, it will be advanced thereby to the inlet roller pair 46.

The conveyor section D comprises a conveyor belt 64 passed over a drive roller 62 and a driven roller 63. The motor M drives the drive roller 62 through an electromagnetic clutch 65.

Figure 3:
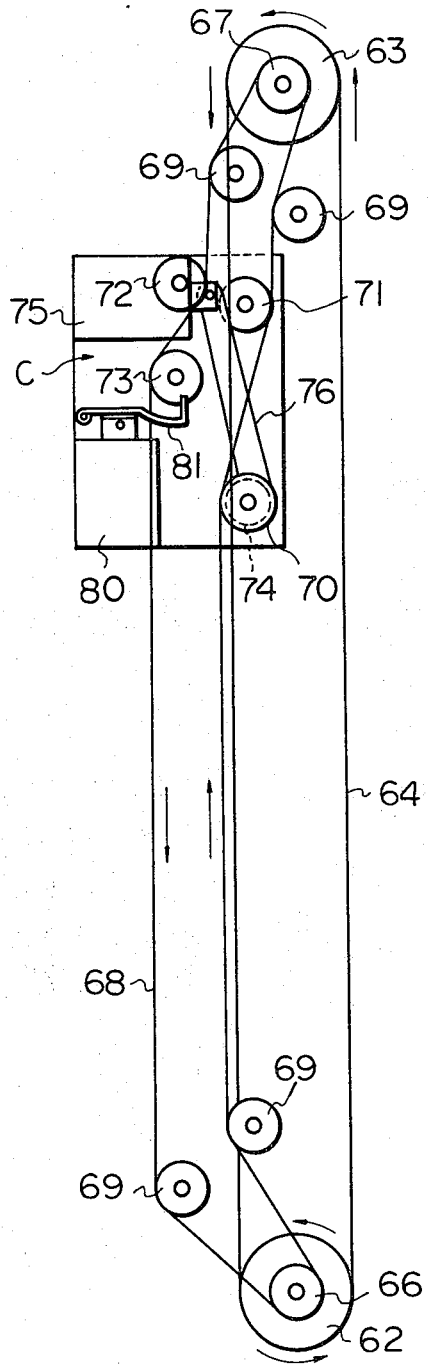
FIG. 3 is a schematic elevation illustrative of cooperation of a conveyor section and a deflector of the collating apparatus.

As shown in FIG. 3, the conveyor belt 64 runs over the drive and driven rollers 62 and 63 while a first chain 68 is passed over a sprocket 66 rigid on the shaft of the drive roller 62 and a sprocket 67 freely rotatable on the shaft of the driven roller 63. It will be seen that, since the diameter of the sprocket 66 is smaller than that of the drive roller 62, the chain 68 rotates at a velocity lower than the velocity of the conveyor belt 64. The chain 68 is also passed over sprockets 69 included in the conveyor section D and sprockets 70, 71, 72 and 73 in the deflector C.

The deflector C will be raised when the chain 68 rotates clockwise in FIG. 3 and vice-versa. For this purpose, a spring clutch 74 is associated with the sprocket 70 and mounted on a stationary shaft of the deflector C. The spring clutch 74 is operated by an elevation solenoid 75 through a lever 76. When the solenoid 75 is energized, the clutch 74 will be uncoupled to render the sprocket 70 free and thereby cause only the chain 68 to rotate with the deflector C kept stationary. When the solenoid 75 is de-energized, the lever 76 will spring back to the original position and the sprocket 70 will be locked to the stationary shaft through the clutch 74. This allows the chain 68 to move with the sprocket 70 and, therefore, the deflector C during its upward travel. When the deflector C reaches the uppermost position where it is to stop, it actuates a home position switch 85 (FIG. 6) which in turn energizes the solenoid 75. Then the clutch 74 is uncoupled, the deflector C thus disconnected from the chain 68 stops its upward movement.

Figure 4:
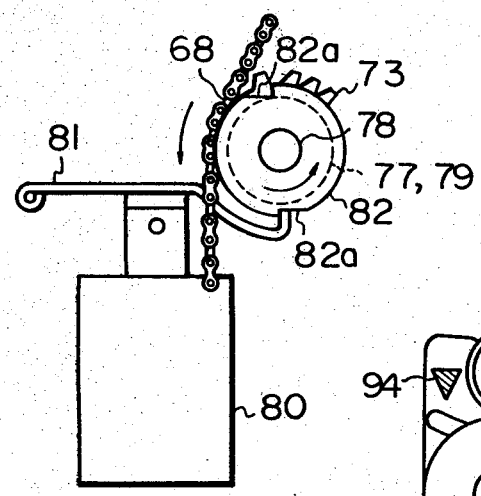
FIG. 4 shows a clutch control mechanism for lowering the deflector.
Figure 5:
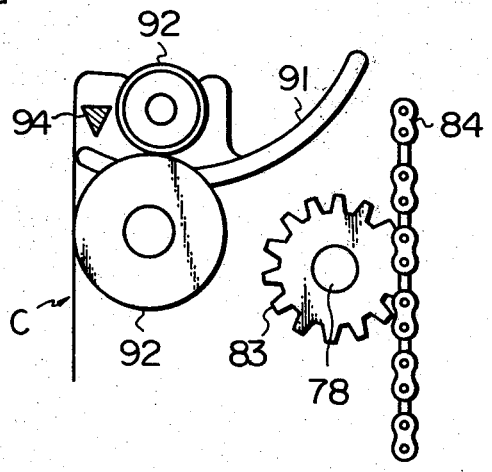
FIG. 5 illustrates stepwise feed of the deflector.

Concerning the downward movement of the deflector C, it is essentially the same as the upward movement discussed above except that it must be precisely by an incremental amount. As shown in FIG. 4, this is achieved by the provision of the sprocket 73 meshed with the chain 68, a spring clutch 77 associated with the sprocket 73, an electromagnetic clutch 79 intervening between the spring clutch 77 and a shaft 78, a solenoid 80 adapted to couple and uncouple the spring clutch 77 for lowering the deflector C, a lever 81 connected with the plunger of the solenoid 80, and a cam sleeve 82 having diametrically opposite slots 82*a* engagable with one end of the lever 81 and functioning to control coupling and uncoupling of the spring clutch 77. As seen in FIG. 5, the shaft 78 also rigidly carries therewith a sprocket 83 which is secured to the conveyor section D and, thus, meshes with a stationary second chain 84.

When the solenoid 80 is de-energized, the actuating end of the lever 81 is engaged in one slot 82*a* of the cam sleeve 82 to uncouple the spring clutch 77 so that, though the chain 68 may rotate the sprocket 73, the shaft 78 remains stationary keeping the deflector C stationary. Upon energization of the solenoid 80, the actuating end of the lever 81 is disengaged from the slot 82*a* to couple the spring clutch 77. Then the rotation of the sprocket 73 driven by the chain 68 is transmitted to the shaft 78 by the electromagnetic clutch 79 which is usually kept coupled, causing the sprocket 83 to rotate together with the shaft 78. Consequently, the sprocket 83 rolls down along the stationary second chain 84 allowing downward movement of the deflector C. Immediately after the lever 81 has been disengaged from the slot 82*a*, the solenoid 80 is again de-energized so that the actuating end of the lever 81 slides along the periphery of the cam sleeve 82 in engagement therewith. After a half turn, the lever 81 engages the second diametrically opposite slot 82*a* on the cam sleeve 82 whereby the rotation of the cam sleeve 82 is interrupted. The spring clutch 77 is again uncoupled stopping the downward movement of the deflector C through the shaft 78 and sprocket 83. In this way, the deflector C is indexed downward a distance precisely corresponding to the half turn of the cam sleeve 82 and this distance is equal to the distance between neighboring bins.

Figure 6:
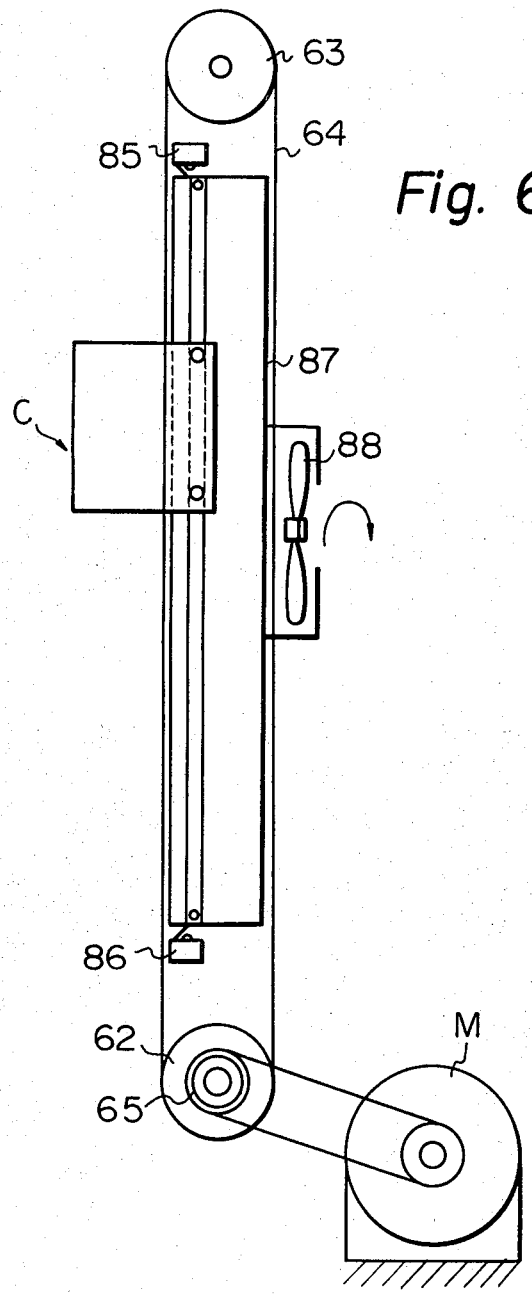
FIG. 6 shows the conveyor section.

Turning to FIG. 6, the opposite vertical runs of the conveyor belt 64 which pass over the rollers 62 and 63 have a vacuum chamber 87 therebetween. A blower 88 constantly supplies the vacuum chamber 87 with vacuum. A wall portion of the vacuum chamber 87 which confronts the array of bins and is engaged by the conveyor belt 64 is formed with rows of suction holes, and the conveyor belt 64 is also formed with like apertures. The reference numeral 86 denotes an end detection switch responsive to the downward movement of the deflector C. When a copy sheet arrives at the conveyor section at the time the apertures of the conveyor belt 64 have aligned with those of the vacuum chamber wall, it is sucked onto the conveyor belt 64 and carried thereby to the deflector C. A deflecting cam 89 shown in FIG. 7 deflects the copy sheet into a selected bin.

Figure 7:
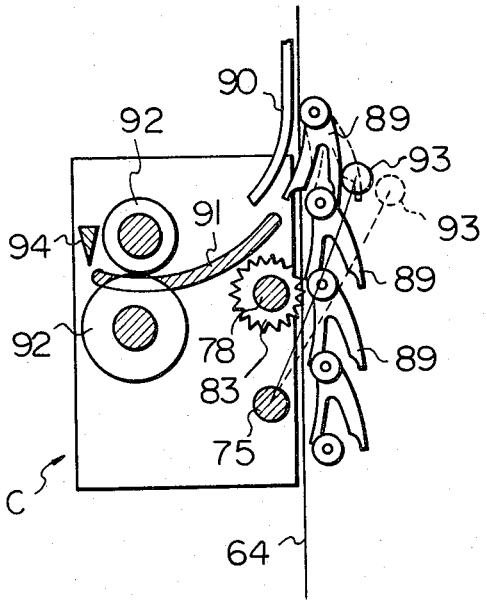
FIG. 7 is explanatory of cooperation of the deflector and deflecting cam.

As shown in FIG. 7, a plurality of deflecting cams 89 are disposed in correspondence with individual bins in the collator 2. Let it now be assumed that the deflector C has stopped in a position corresponding to an intended bin. In this situation, one of the deflecting cams 89 corresponding to the selected bin remains projected from the conveyor belt 64 so that a copy sheet fed by the conveyor belt 64 to the deflector C is separated from the conveyor belt 64 by the curved guide surface of the deflecting cam 89. Then the copy sheet advances between guide plates 90 and 91 supported by the deflector C and is discharged by a discharge roller pair 92 into the selected bin.

The position of the deflecting cam 89 projected beyond the conveyor belt 64 is established when a cam drive lever 93 of the deflector C is locked in the solid line position. This lever 93 remains in the solid line position during downward movement of the deflector so as to cause a selected deflector cam 89 to project as mentioned above while, during upward movement of the deflector C, shifting to the phantom line position where it becomes clear of the deflector cams 89. The aforementioned solenoid 75 controls the actions of the lever 93. When the solenoid 75 is de-energized, the deflector C will be elevated with the lever 93 held in the phantom line position shown in FIG. 7. With the solenoid 75 energized, the lever 93 will assume the solid line position and the deflector C will be in a position awaiting energization of the solenoid 80. The reference numeral 94 designates a sheet sensor disposed in the deflector C.

Figure 8:
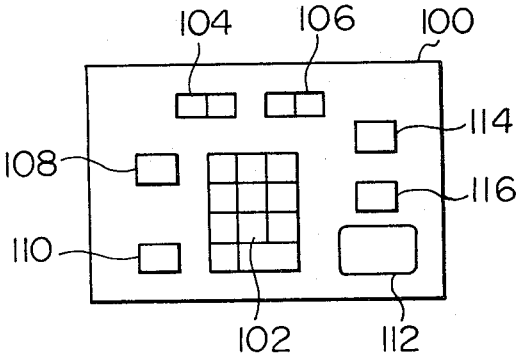

FIG. 8 illustrates a control panel 100 mounted on the copying machine 1. As shown, the control panel 100 has thereon numeral keys or ten keys 102, a first display 104 indicating a desired number of copy sheets preset through the ten keys 102, a second display 106 indicating the number of sheets successively fed out from the sheet feed station 20 and other similar displays 108 and 110. Also carried on the control panel 100 are a print start key 112 and other function keys 114 and 116.

Figure 9:
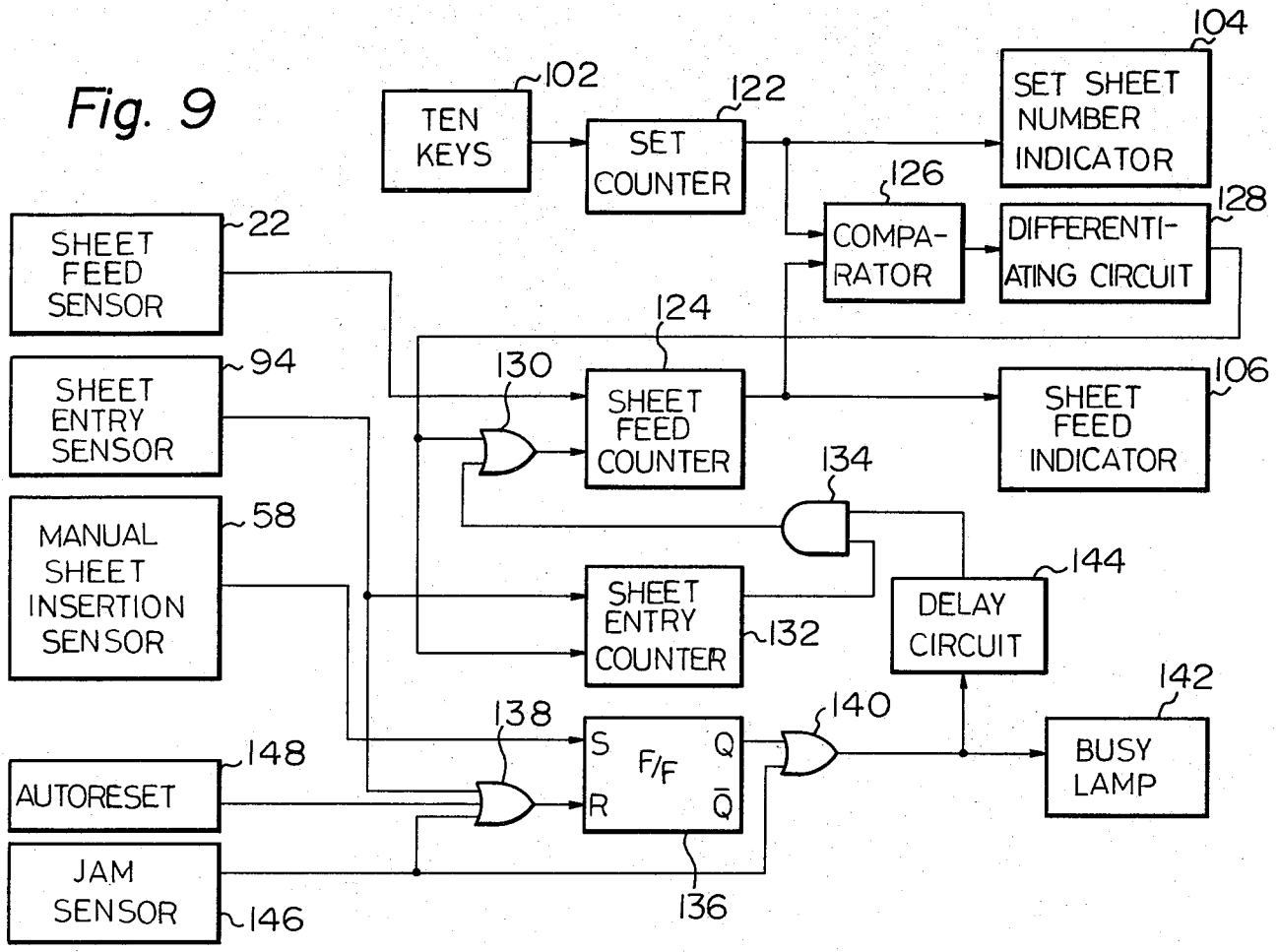
FIG. 9 is a block diagram of a control circuit associated with the copying machine and the collating apparatus.

A control circuit 120 is shown in FIG. 9 which is designed to control the copying machine 1 and collator 2 according to the present invention. The control circuit 120 includes a set counter 122 which serves as means for storing the desired number of copies preset through the ten keys 102 as mentioned. The copy number display 104 is connected with this counter 122 to indicate the count thereof. A sheet feed counter 124 functions to control the number of copy sheets to be prepared and is connected with the sheet feed sensor 22 and also with the sheet feed display 106. A comparator 126 is adapted to compare the counts of the two counters 122 and 124 and produce "1" output when the count of the sheet feed counter 124 has become larger than that of the set counter 122. Output of this comparator 126 is coupled to the sheet feed counter 124 through a differentiating circuit 128 and an OR gate 130. Connected with the sheet entry sensor 94 is a sheet entry counter 132 which passes its output to one input of the OR gate 130 via an AND gate 134. The other input of the OR gate 130 receives output of the differentiator 128. A flip-flop 136 is connected with the manual sheet insertion sensor 58 to be set by its output. The flip-flop 136 receives at its reset terminal R a jam signal from a jam sensor 146, an autoreset signal from an autoreset signal generator 148 and an output signal of the sheet entry sensor 94 each through a common OR gate 138. A signal from the output terminal Q of the flip-flop 136 is coupled to an OR gate 140 together with the jam signal. Output of the OR gate 140 turns on a busy lamp 142 to inhibit any further operation of the copying machine while being supplied through a delay circuit 144 to the other input terminal of the AND gate 134.

With this arrangement, operator first sets a desired number of copy sheets in the set counter 122 through the ten keys 102. Supposing that the desired number of copies is three, subsequent depression of the print start key 112 causes the copying machine to perform three copying cycles and the resultant three copy sheets are delivered into individual selected bins in the collator 2. The same actions will occur on the next document page. The sheet feed counter 124 counts up the sheets fed out from the sheet feed station in response to output signals of the sheet sensor 22. As the counter 124 reaches count "4" beyond count "3" which is the preset number of sheets, "1" output appears from the comparator 126 and this is applied to the sheet feed counter 124 via the differentiator 128 and OR gate 130. Then the counter of the counter 124 becomes "1" and it starts counting sheets which will be supplied for the next page of document. In this way, the copying machine produces three copy sheets on each document page.

Now, suppose that the first copy sheet of the desired three has become jammed in the copying machine. Then the busy lamp 142 is turned on by a jam signal from the jam sensor 146 and any further copying operation of the copier is inhibited. Operator will then pick up the jammed sheet out of the copying machine and, if the sheet is acceptable, introduce it into the collator through the manual sheet insertion device shown in FIG. 2. When the acceptable copy sheet or even a colored or like non-copied sheet is put into the manual insertion section F of FIG. 2 along the guides 56 and 57 as indicated by an arrow, it is detected by the sheet sensor 58 and driven by the rollers 59 and 46 into the collator. At this instant, the output of the sheet sensor 58 sets the flip-flop 136 whereby the busy lamp 142 is turned on as in the case of a sheet jam and the copying machine is disabled. As the manually inserted sheet from the section F enters a specific bin of the array E in the collator, the sheet entry sensor 94 detects it and couples its output to the sheet entry counter 132 to thereby increment the count thereof by one. Then output of the counter 132 opens the AND gate 134 in combination with output of the flip-flop 136 supplied thereto through the delay circuit 144 whereby the sheet feed counter 124 has its count made "1." As a result, the display 106 on the control panel 100 indicates the number of sheet delivered into the bin. The output signal of the sheet sensor 94 also resets the flip-flop 136 and thereby turns off the busy lamp 142 rendering the system ready for the next copying cycle. When the operator depresses the print start key 112 again, the copying machine will operate to produce and discharge the other two copy sheets due to the existing count "1" of the sheet feed counter 124.

Suppose that four sheets have been introduced into the collator through the manual insertion section F where the preset number of desired copy sheets is three. Upon entry of the 4th sheet in a selected bin, the sheet sensor 94 detecting this makes the count of the sheet entry counter 132 "4" with its output. Output of the counter 132 is then applied to the sheet feed counter 124 via AND gate 134 together with the output of the delay circuit 144, making the count of the sheet feed counter 124 also "4." The comparator 126 compares the output of the sheet feed counter 124 with that of the set counter 122 and, since the former which is "4" is larger than the latter which is "3," it produces "1" output. This is coupled through the differentiator 128 to the sheet feed counter 124 and sheet entry counter 132 whose counts then become both "1." Furthermore, suppose that the number of sheets manually inserted through the section F is five. In this case, the counts of the counters 124 and 132 will have been brought back to "1" at the instant of delivery of the 4th sheet. Therefore, the counters 124 and 132 count up the 5th sheet and become "2." When under this condition the operator depresses the print start key 112, the copying machine will repeat the copying cycle until the number of sheets fed coincides with the preset number. In this case, however, it will produce the remaining one copy because two copy sheets have already been delivered. These actions will occur in the same way when monochromatic sheets or like additional sheets are introduced into the collator through the manual insertion section F halfway in a binding process.

As described above, the number of sheets delivered from the manual insertion section F of the collator 2 can be displayed in the same way as the copy sheets fed from the copying machine 1. Where the number of sheets introduced through the section F is less than that of the preset number, the copying machine will repeat its copying cycle for making up the shortage. If the number of manually inserted sheets is larger than the preset number, the count will return to "1" when the former has exceeded the latter and the copying machine will operate to replenish the shortage which is difference between the count, which will increment from "1" thereafter, and the preset number.

In summary, it will be seen that the present invention provides an improved copying machine with a collator which permits sheets to be readily loaded in the collator independently of copy sheets from the copying machine and, after the manual sheet insertion, continues its copying operation to produce the remaining short number of copy sheets. This is because the collator is provided with a manual insertion device and because the count of a sheet feed counter is corrected in response to output signals of a manual sheet insertion sensor and according to the count of a sheet entry counter.

Various other modifications will become possible for those skilled in the art after receiving the teachings of the present disclosure without departing from the scope thereof. For example, the manual sheet insertion device may be provided in the copying machine body.

What is claimed is:

1. A copying machine including a collating apparatus provided with a manual sheet insertion device, comprising:

setting means for setting a number of sheets to be copied by the copying machine;

sheet feed sensor means provided in a sheet feed station of the copying machine to detect feeding of sheets from the sheet feed station;

manual sheet insertion sensor means provided in the manual sheet insertion device to detect insertion of a sheet into the manual sheet insertion device;

sheet entry sensor means provided in the collating apparatus to detect entry of sheets into bins of the collating apparatus; and control means responsive to outputs of the setting means, the sheet feed sensor means, the manual sheet insertion sensor means and the sheet entry sensor means to control the copying machine and the collating apparatus such that when a sheet is manually inserted into the manual sheet insertion device, a number of sheets fed from the sheet feed station is automatically corrected in response to the entry of said sheet into a desired bin of the collating apparatus.

2. A copying machine as in claim 1, further comprising a jam sensor means for detecting a sheet jam and producing a jam signal in response thereto.

3. A copying machine as claimed in claim 2, in which the control means comprises:

set sheet number storage means responsive to an output of the setting means to store a set number of sheets to be copied;

sheet feed counter means responsive to an output of the sheet feed sensor means to count a number of sheets fed from the sheet feed station;

sheet entry counter means responsive to an output of the sheet entry sensor means to count a number of sheets discharged into the bins;

comparator means for comparing the set number of sheets to be copied with the number of sheets fed from the sheet feed station and producing an output when the latter number is greater than the former set number, said output of the comparator means being fed to the sheet feed counter means and the sheet entry counter means; and inhibiting means for inhibiting the copying operation of the copying machine within a predetermined length of time in response to at least one of outputs of the manual sheet insertion sensor means and the jam sensor means.

4. A copying machine as claimed in claim 3, further comprising an autoreset signal generator means, the inhibiting means comprising a flip-flop having a set input responsive to the output of the manual sheet insertion sensor means and a reset input responsive to at least one of outputs of the sheet entry sensor means, the jam sensor means and the autoreset signal generator means, OR gate means having an input responsive to a set output of the flip-flop and another input responsive to the jam signal of the jam sensor means, and delay circuit means responsive to an output of the OR gate means.

5. A copying machine as claimed in claim 4, in which the control means further comprises AND gate means having an input responsive to an output of the delay circuit means and another input responsive to the output of the sheet entry counter means, an output of the AND gate means being fed to the sheet feed counter means.

6. A copying machine as claimed in claim 3, further comprising set sheet number indicator means responsive to an output of the set sheet number storage means.

7. A copying machine as claimed in claim 3, further comprising sheet feed indicator means responsive to an output of the sheet feed counter means.

8. A copying machine as claimed in claim 4, further comprising a busy indicator means responsive to an output of the OR gate means.

9. A copying machine as claimed in claim 1, in which the setting means comprises ten keys.

* * * * *